US008944969B2

(12) United States Patent
Giannelli

(10) Patent No.: US 8,944,969 B2
(45) Date of Patent: Feb. 3, 2015

(54) ROWING MACHINE

(75) Inventor: Raymond Giannelli, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 3598 days.

(21) Appl. No.: 10/378,261

(22) Filed: Mar. 3, 2003

(65) Prior Publication Data

US 2003/0166439 A1 Sep. 4, 2003

Related U.S. Application Data

(60) Provisional application No. 60/361,622, filed on Mar. 4, 2002.

(51) Int. Cl.
*A63B 21/00* (2006.01)
*A63B 23/12* (2006.01)
*A63B 21/062* (2006.01)

(52) U.S. Cl.
CPC ..... *A63B 23/12* (2013.01); *A63B 21/062* (2013.01); *A63B 2208/0233* (2013.01)
USPC ..... 482/72; 482/51

(58) Field of Classification Search
USPC ..... 482/136, 72, 73, 97–101, 130, 142, 52, 482/51, 62
See application file for complete search history.

(56) References Cited

U.S. PATENT DOCUMENTS 5,135,449 A 8/1992 Jones
5,135,456 A 8/1992 Jones
5,273,505 A 12/1993 Jones
5,304,107 A 4/1994 Jones
5,336,148 A * 8/1994 Ish, III ..... 482/98
5,437,589 A 8/1995 Habing
5,486,150 A * 1/1996 Randolph ..... 482/133
5,620,402 A 4/1997 Simonson
5,707,323 A 1/1998 Simonson
5,769,757 A 6/1998 Fulks
5,971,896 A 10/1999 Giannelli et al.
5,989,165 A 11/1999 Giannelli et al.
5,997,447 A * 12/1999 Giannelli et al. ..... 482/100
6,056,678 A 5/2000 Giannelli et al.
6,071,216 A * 6/2000 Giannelli et al. ..... 482/100
6,142,917 A 11/2000 Giannelli et al.
6,152,864 A 11/2000 Giannelli et al.
6,203,474 B1 3/2001 Jones
6,254,516 B1 * 7/2001 Giannelli et al. ..... 482/100
6,682,466 B1 * 1/2004 Ellis ..... 482/142

* cited by examiner

*Primary Examiner* — Jerome w Donnelly
(74) *Attorney, Agent, or Firm* — Novak Druce Connolly Bove + Quigg LLP

(57) ABSTRACT

A rowing exercise machine provides a declining, substantially linear path of motion while offering a consistent force angle at the grip. This allows for a fairly consistent torque application at the shoulder joint, throughout the range of motion of the exercise. The exercise machine includes an input assembly which enables a user to maintain biomechanical alignment of the user's wrist and forearm during performance of the exercise, while maintaining a consistent torque applied to the shoulder joint, in the stability of an exercise machine. The input assembly defines a declining, substantially linear path, where the user's forearms remain substantially parallel to the ground as the input assembly is drawn back.

25 Claims, 5 Drawing Sheets

ROWING MACHINE

CROSS-REFERENCE TO RELATED APPLICATION

This application is related to and claims priority to U.S. Provisional Patent Application Ser. No. 60/361,622, filed Mar. 4, 2002, entitled ROWING MACHINE, the entirety of which is incorporated herein by reference.

STATEMENT REGARDING FEDERALLY SPONSORED RESEARCH OR DEVELOPMENT n/a

FIELD OF THE INVENTION

The present invention relates to the field of exercise and physical rehabilitation equipment, and in particular to an apparatus for exercising the upper body.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance. Various routines have been developed to exercise different muscle groups by forcing the muscles to contract and extend under a load, such as by moving a free weight against the force of gravity or by moving a handle whose movement is resisted by an exercise machine.

One such exercise is known as a row exercise, where the latisimus dorsi muscles are exercised. An exerciser lies prone on a bench, or bends at the waist, and grasps a barbell below him. The exerciser then pulls the barbell towards his torso and lowers it down. This exercise can be dangerous as the exerciser may drop the barbell. Additionally, as the arms are drawn towards the torso, it is difficult to keep them low enough with respect to the trunk to involve the latisimus effectively. If the user pulls the bar towards the chest, the ability of the latisimus dorsi muscles to move the resistance decreases.

Furthermore, the exerciser should have a partner to spot him in case he fails to lift the weight. Even if done properly with a partner, this exercise may not permit the user a full range of exercise since the barbell may hit the user's chest before the back muscles have contracted fully. When using free weights, the resistance provided by gravity is constant while the strength of the muscles varies over the range of motion. Consequently, the muscles are not fully loaded at each point over the range.

To overcome these difficulties, machines have been developed that simulate the exercise movements of a row/rear deltoid exercise. In one apparatus, disclosed in U.S. Pat. No. 5,620,402, a user exercises by pulling handles toward his torso. A seat and chest pad are mounted to a frame to position a user. Arms are rotatably mounted to the frame. The handles are mounted to the arms. The pivot for the arms is disposed above the seat. A cable operably connects the arms to a weight stack such that when a user pulls back on the handles, thereby rotating the arms, the weight stack is lifted and provides resistance to the exercise. The cable may be journaled over a variable radius cam to alter the distance the weight is displaced for a given amount of handle rotation at a particular point in the range of motion. Consequently, the resistance to the movement of the handles can be varied to match the strength curve of the back muscles. Unfortunately, the combination of row and rear deltoid exercise requires compromise for both patterns. The rear deltoid exercise is best performed in a transverse plane. The row exercise is best performed in the sagittal plane. Most row/rear deltoid machines do not have enough vertical motion at the grip to allow for the full range of sagittal plane motion required to do the exercise correctly.

In another apparatus, disclosed in U.S. Pat. No. 5,135,456, a rowing machine is disclosed in which levers are rotatably mounted to a frame. Handles are mounted to the levers. Resistance to handle movement exercise is provided by weight plates mounted to the levers. The hinges for the levers are disposed at diverging angles with respect to a central vertical midplane, such that the user moves his hands in defined arcs in diverging planes as he pulls back on the handles. This apparatus forces the user's hands to be spread apart as the handles are drawn back toward the chest. The diverging motion is successful in greater engagement of the rear deltoid due to it's greater degree of transverse plane motion, but does not allow for enough vertical motion in the sagittal plane to do the row in a way that effectively engages the latisimus dorsi over the greatest range of motion.

It is object of this invention to provide an exercise machine which optimally isolates the latisimus muscle group to maximize muscular benefit during performance of a row movement.

SUMMARY OF THE INVENTION

The subject invention provides a rowing exercise machine with a substantially linear pattern of motion while offering a variable resistance throughout the range of motion of the muscles being trained. The exercise machine includes an input assembly which enables a user to maintain biomechanical alignment of the user's wrist and forearm during performance of the exercise, while maintaining a consistent resistance applied to the muscles, in the stability of an exercise machine. The input assembly is engagable by a user, where the input assembly defines a declining, substantially linear path as the input assembly is moved from a first position to a second position. A user engages the input assembly in the first position, where the user's arms and forearms are substantially parallel to a horizontal plane define by the ground.

In an exemplary embodiment, the input assembly includes a pair of four-bar linkage mechanisms pivotally connected to the frame. The pair of four-bar linkage mechanisms each including a primary lever arm pivotable about a primary axis, a secondary lever arm pivotable about a secondary axis, and a handle operatively associated with both the primary and secondary lever arms. The primary axes are disposed at an angle with respect to the frame such that the handles travel in diverging planes as the handles are drawn back.

Additionally, the handles are pivotally connected to both the primary lever arms and the secondary lever arms, so as to travel in declining, substantially linear paths as the handles are drawn back. The declining, substantially linear path enables the user to maintain the proper biomechanical alignment of the force angle being applied to the grip. This allows for a fairly consistent torque application at the shoulder thoughout the range of motion of the exercise. The use of the four bar linkage allows for an insignificant change in angle of the grip throughout the range even though the primary and secondary levers go through a significant change in angle during the same range of motion. This has the effect of allowing the user to maintain proper alignment of the wrist and forearm during performance of the exercise. "Proper" or "correct biomechanical positioning," as used herein, means that the force angle applied to the grip and the orientation of the user's wrist and forearm remains relatively constant from the start to finish of a row exercise motion, i.e., throughout a complete range of motion.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The subject invention provides a rowing exercise machine with a substantially linear range of motion while offering a consistent application of torque throughout the range of motion of the shoulder joint. The exercise machine includes an input assembly which enables a user to maintain biomechanical alignment of the user's wrist and forearm during performance of the exercise, while maintaining a consistent torque applied to the shoulder joint, in the stability of an exercise machine.

Figure 1:
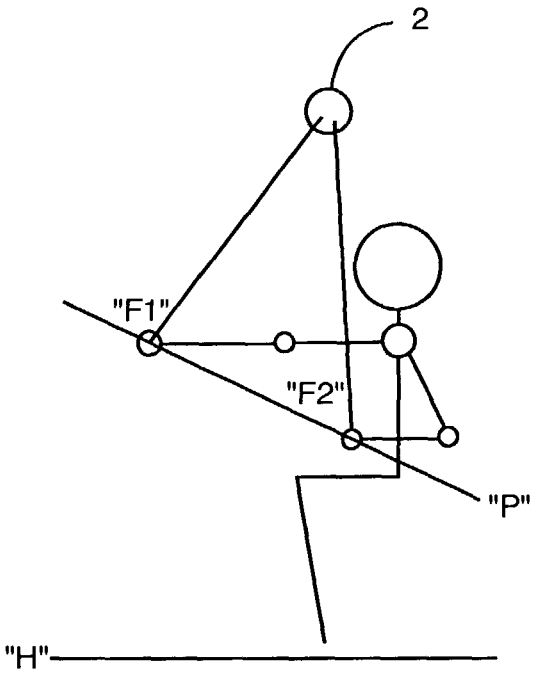
FIG. 1 is a schematic representation of the exercise machine of the present invention.

Referring to FIG. 1, the input assembly 2 defines a substantially linear path "P", wherein the input assembly 2 travels to the nadir of the substantially linear path "P" when the input assembly 2 is moved from a first position "F1" to a second position "F2." Similarly, the input assembly 2 travels to the apex of the substantially linear path "P" when the input assembly 2 is the moved from the second position "F2" to the first position "F1." The input assembly is configured to keep the user's forearms substantially parallel to the ground as the input assembly travel along the substantially linear path "P."

Figure 2:
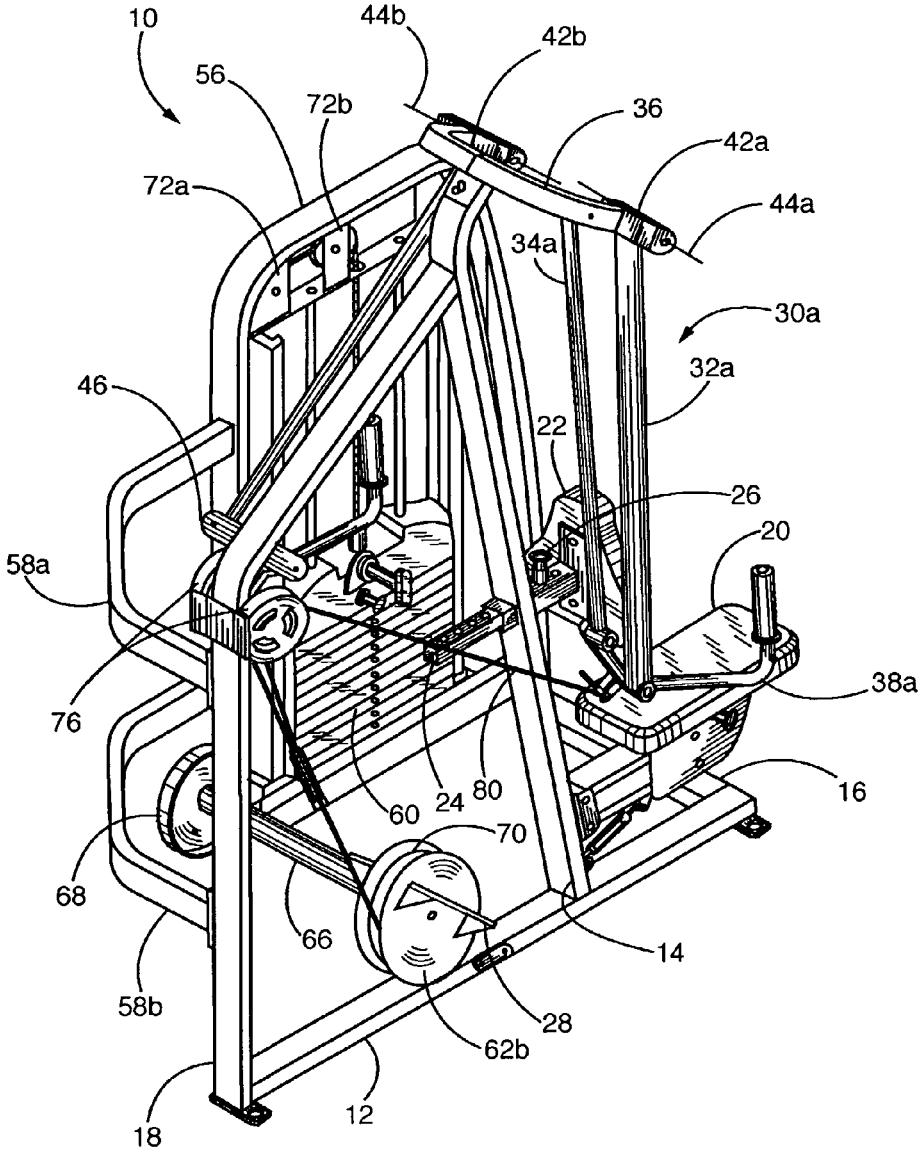
FIG. 2 is a rear perspective view of the row exercise machine of the present invention.

In an exemplary embodiment, as shown in FIG. 2, the exercise machine 10 of the present invention includes a support frame 12 having a front leg 14, rear base 16, and a vertical support 18. A seat 20 is mounted to the front leg 14 of the support frame 12. The seat 20 is adapted to be positioned at various heights along the front leg 14 to provide a comfortable position for users of varying stature. A chest pad 22 is mounted on the front leg 14 above the seat 20 by a chest pad rod 24. In an exemplary embodiment, the front leg 14 angles away from the seat 20 in an upward direction where the chest pad 22 is disposed forward of the seat 20. The chest pad rod 24 may be of an adjustable length, such as by means of a telescoping rod held in position by a pin/detent connection 26. The adjustable-length chest pad rod 24 allows users of varying stature to be positioned at different distances from the machine, thereby permitting a full range of motion. Foot braces 28 are mounted to the bottom of the support frame 10 and are disposed in front of the seat 20. The foot braces 28, seat 20 and chest pad 22 comprise the user support adapted to maintain the user in a comfortable, stable position for exercising.

Figure 3:
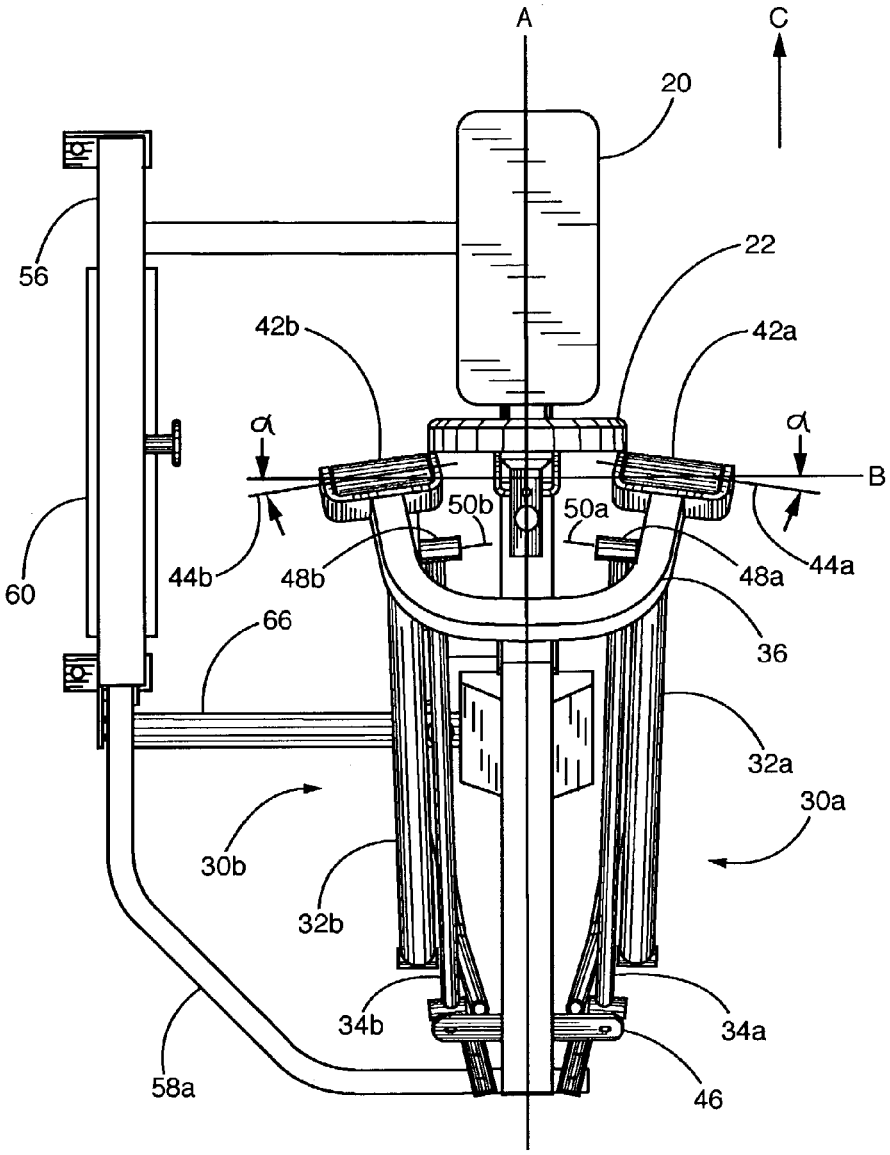
FIG. 3 is a top view of the row exercise machine of the present invention.

Referring to FIGS. 2 and 3, the input assembly includes four bar linkage mechanisms 30*a* and 30*b* pivotally mounted at the distal ends to an upper support frame 36. Four bar linkages 30*a* and 30*b* are symmetrical in construction, therefore, the below detailed description of linkage 30*a* is applicable to symmetrical linkage 30*b* as well. Four bar linkage 30*a* includes primary lever arm 32*a*, a secondary lever arm 34*a*, and a handle 38*a*. The primary lever arm 32*a* and secondary lever arm 34*a* lie and travel in a common plane which minimally diverges from a vertical midplane "A" as the primary lever 32*a* and the secondary lever 34*a* are drawn back in the direction of arrow "C", where vertical midplane "A" longitudinally bisects the seat 20. The divergence of the common plane is sufficient to allow the handles 38*a* and 38*b* to pass on opposite sides of the user.

The primary lever arm 32*a* is an elongated bar which is pivotally connected at its proximal end to the handle 38*a*. The distal end of the primary lever arm 32*a* is pivotally connected to the upper support frame 36 by primary axle 42*a* disposed about primary axis 44*a*.

Secondary lever arm 34*a* is similarly an elongated bar which is pivotally connected at its proximal end to handle 38*a*, and is pivotally connected at its distal end to the upper support frame 38 by secondary axle 48*a*. The secondary axle 48*a* is axially disposed about secondary axis 50*a*. The primary axis 44*a* is disposed at an angle $\alpha$ with respect to a horizontal plane "B".

In an exemplary embodiment, the secondary axles 50*a* and 50*b* are spaced from and are parallel to the primary axles 44*a* and 44*b*.

Figure 4:
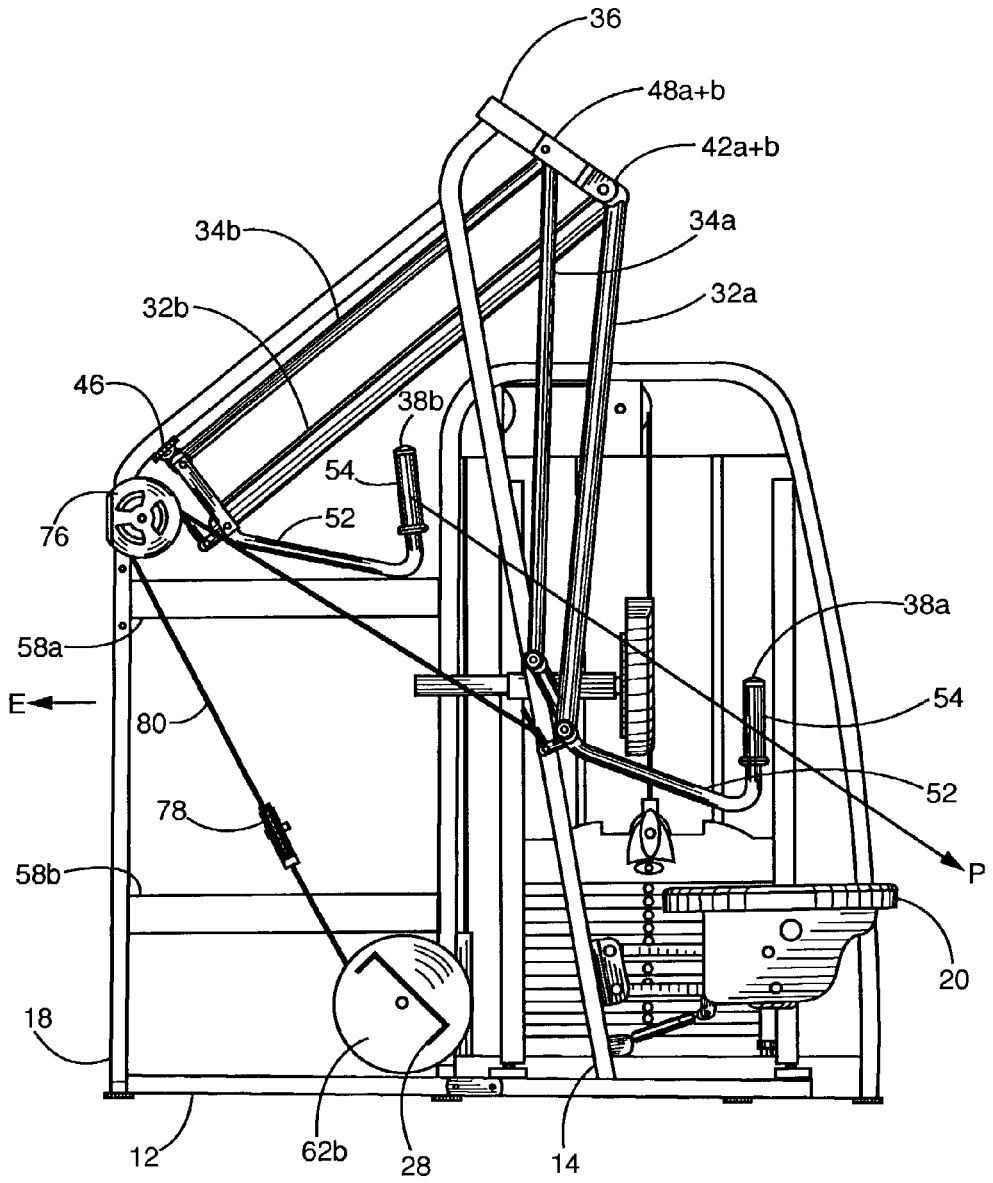
FIG. 4 is a left side view of the row exercise machine of the present invention.

As shown in FIG. 4, the handle 38*a* is the forward most component of the four bar linkage 30*a*. The handle 38*a* includes a first handle portion 52 and a second handle portion 54 curving upwardly from the first portion 52, at about, for example, a 120-degree angle. The relationship of the primary lever arm 32*a* with the secondary lever arm 34*a* is in an unequal length configuration. The unequal lengths force the handle 38*a* to tilt downwardly as the primary lever arm 32*a* moves from a first position to a second position. The effect this has is to cause grip 54 to mover in a substantially linear path defined as "P" even though the primary lever arm 32*a* is restricted to an arcuate path of motion. The angular displacement of the handle 38*a*, with respect to the ground plane, that is required to maintain a substantially linear path "P" is small in magnitude. The small angular displacement of the handle 38*a* helps maintains the grip 54 in a substantially vertical position. This enables the user to maintain the proper biomechanical alignment of the user's wrist and forearm during performance of the exercise. "Proper" or "correct biomechanical positioning," as used herein, means that the orientation of the user's wrist and forearm remains relatively constant from the start to finish of a row exercise motion, i.e., throughout a complete range of motion.

Additionally, a stop plate 46 is mounted onto the vertical support 18, where the stop plate 46 engages secondary lever arm 34*a* when the exercise machine 10 is not in use. The stop plate 46 limits the rearward movement of four bar linkages 30*a* and 30*b* in the direction of arrow "E."

Figure 5:
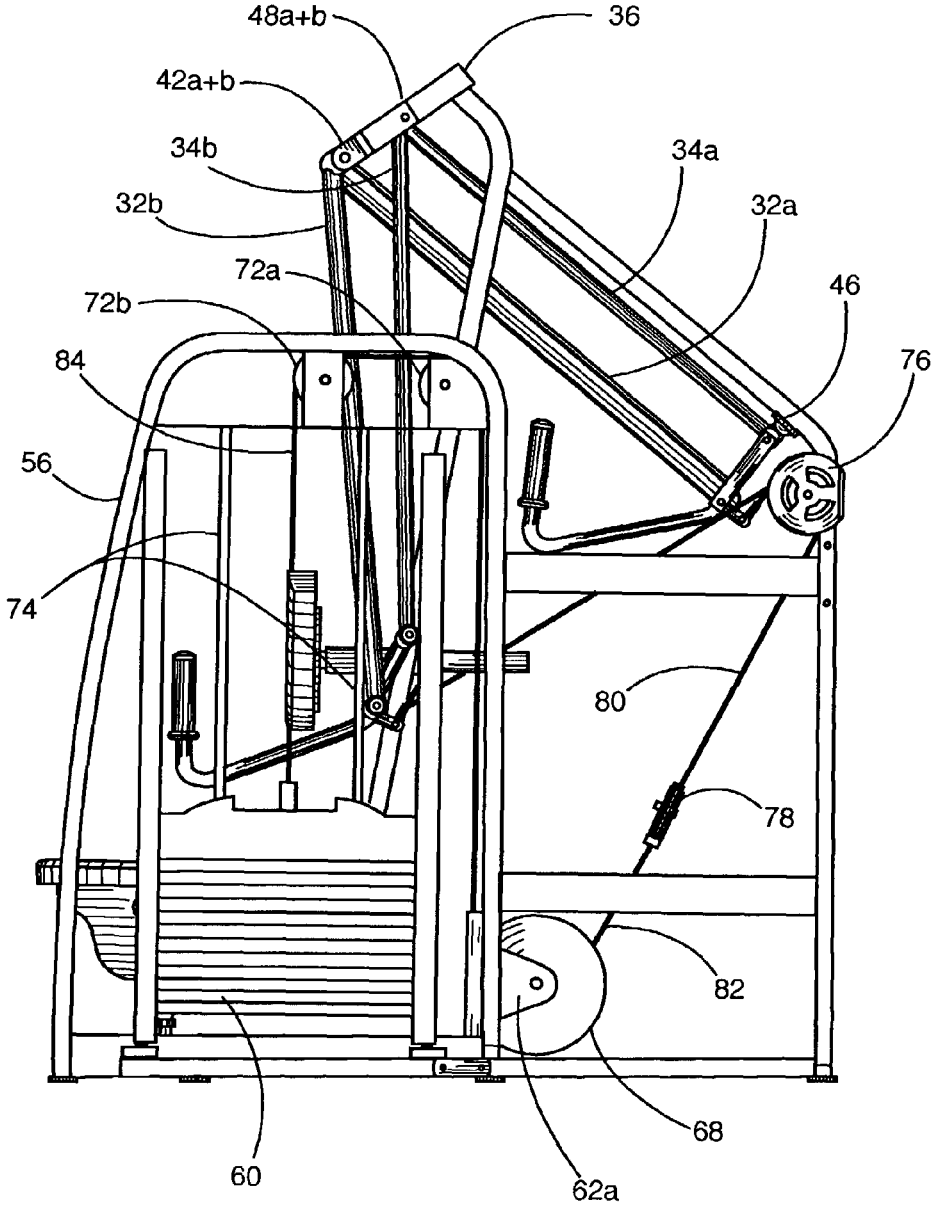
FIG. 5 is a right side view of the row exercise machine of the present invention.

In an exemplary embodiment, as shown in FIG. 5, a weight stack frame 56 is attached to the support frame 12 by beams 58*a* and 58*b*, where the weight stack 60 is easily accessed by a user seated in seat 20. Connection bridges 62*a* and 62*b* (See also FIG. 4) are rigidly mounted to the front leg 14 and the weight stack frame 56, respectively. The bridges 62A and 62*b* support a transmission 64, including a shaft 66, a first cam 68 and a second cam 70. (See also FIG. 2) A weight stack pulley set 72*a* and 72*b* is mounted to the top of the weight stack frame 56, with pulley 72*a* aligned with the first cam 52 and pulley 72*b* aligned with the weight stack 60. Guide rods 74 are mounted vertically within the weight stack frame 56. The weight stack 60 is glidingly mounted to the guide rods 74 and provides a resistance to the exercise.

In alternative embodiments, other mechanisms for providing resistance, such as friction fitting, springs, elastic bands, hydraulic, pneumatic or electromagnetic resistance, or an air resistance fan could be employed (either alone or in combination) and still practice the invention. Additionally, free weights could be operable engaged to the four-bar linkage 30*a* and 30*b* to resist the movement.

In an embodiment, as shown in FIGS. 2-5, the handles 38*a* and 38*b* are operably connected to the weight stack 60 via the transmission system 64. A pair of frame pulleys 76 are mounted to the vertical support 18 of the support frame 12. A lifting pulley 78 is operably connected to the handles 38*a* and 38*b* by a first cable 80, wherein the first cable 80 is threaded about and through the pair of frame pulleys 76, such that the lifting pulley 78 is positioned above the second cam 70. A lifting cable 82 connects the lifting pulley 78 to the second cam 70, where the second cam 70 is caused to rotate when at least one of the handles 38*a* or 38*b* is pulled back.

A belt 84 is attached at one end to the first cam 68, extending over the weight stack pulleys 72*a* and 72*b* and attached to the weight stack 60 at the opposite end. (See also FIG. 5). As the user pulls back on the handles 38*a* and 38*b*, the lifting pulley 78 is raised, causing the lifting cable 80 to unwind and rotate the second cam 70. As the second cam 70 rotates, the shaft 66 and the first cam 68 rotate as well. The rotation of the first cam 68 pulls the belt 84 over the weight stack pulleys 72*a* and 72*b*, and thus lifts the weight stack 60.

In an exemplary method of operation, a weight is selected on the main weight stack 60 by placing a pin (not shown) in one of the holes, as is known in the art. The user adjusts the seat 20 and chest pad 22 to a suitable position on the front leg 14. For example, a user with a longer torso will adjust the seat to a lower height such that the handles 38*a* and 38*b* are positioned at a comfortable height parallel with the users shoulders. The chest pad 22 is adjusted such that when the user grasps the handles tension is placed on the lifting cable 80. The user grasps the handles 38*a* and 38*b* and pulls back causing the lifting pulley 78 to be raised. As the lifting pulley 78 is raised, the first cam 70, shaft 66, and second cam 68 rotate, pulling on the belt 84 and lifting the selected weight. The user then returns the handles 38*a* and 38*b* to the initial position, thereby lowering the weight. When the user pulls the handles 38*a* and 38*b* back, the resistance provided by the weight is overcome. When the user returns the handles 38*a* and 38*b*, the user succumbs to the resistance provided by the weight.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A row exercise machine comprising an input assembly including a first handle portion adapted to be moved from a first position to a second position by a pulling force exerted by a user on the first handle portion in a rowing motion, the input assembly defining a substantially linear path for the first handle portion from the first position to the second position.

2. The exercise machine exercise machine according to claim 1, further comprising a second handle portion, wherein the first handle portion and the second handle portion travel in diverging planes as the first handle portion and the second handle portion are moved from the first position to the second position.

3. The exercise machine exercise machine according to claim 1, further comprising a second handle portion, wherein the first handle portion and the second handle portion travel in converging planes as the first handle portion and the second handle portion are moved from the second position to the first position.

4. The exercise machine exercise machine according to claim 1, further comprising a frame, wherein the input assembly is pivotally mounted to the frame.

5. The exercise machine exercise machine according to claim 4, wherein the input assembly is pivotally mounted to the frame forward and above a user.

6. The exercise machine exercise machine according to claim 1, further comprising a resistance mechanism operably connected to the input assembly.

7. The exercise machine exercise machine according to claim 1, wherein the first handle portion is substantially vertically oriented.

8. The exercise machine according to claim 1, wherein, the first handle portion travels to a nadir of the substantially linear path as the first handle portion is moved from the first position to the second position and the first handle portion travels to an apex of the substantially linear path as the first handle portion is moved from the second position to the first position.

9. The exercise machine according to claim 8, further comprising a second handle portion operatively connected to the input assemble, the second handle portion traveling to the nadir of the substantially linear path as the second handle portion is moved from the first position to the second position and the second handle portion traveling to the apex of the substantially linear path as the second handle portion is moved from the second position to the first position.

10. The exercise machine according to claim 9, wherein the first handle portion and the second handle are adapted to be grasped by a user, such that the forearms of a user remain substantially parallel to the ground as the first handle portion and the second handle are moved from the first position to the second position and the first handle portion and the second handle portion are moved from the second position to the first position.

11. The exercise machine according to claim 9, wherein the first handle portion and the second handle travel in diverging planes as the first handle portion and the second handle are moved from the first position to the second position.

12. The exercise machine according to claim 9, wherein the first handle portion and the second handle portion travel in converging planes as the first handle portion and the second handle portion are moved from the second position to the first position.

13. The exercise machine according to claim 9, wherein the input assembly comprises a pair of four-bar linkage mechanisms pivotally connected to the frame, the pair of four-bar linkage mechanisms each including a primary lever arm pivotable about a primary axis, a secondary lever arm pivotable about a secondary axis, and the first handle portion and the second handle portion operatively associated with one each of the primary and secondary lever arms.

14. The exercise machine according to claim 1, further comprising a user support structure including: a seat mounted to the frame; and a chest pad mounted to the frame above and in front of the seat.

15. A row exercise machine comprising: a frame; an input assembly pivotably mounted to the frame forward and above of a user, the input assembly including a first handle portion and a second handle portion and defining a substantially linear path for the first handle portion and the second handle portion from a first position to a second position by a pulling force exerted by a user on the first handle portion in a rowing motion; and a resistance mechanism operably connected to the input assembly.

16. The exercise machine according to claim 15, wherein the first handle portion and the second handle portion travel to a nadir of the substantially linear path as the first handle portion and the second handle portion are moved from the first position to the second position and the first handle portion and the second handle portion travel to an apex of the substantially linear path as the first handle portion and the second handle portion are moved from the second position to the first position.

17. The exercise machine according to claim 15, wherein the first handle portion and the second handle portion travel in diverging planes as the first handle portion and the second handle portion are moved from the first position to the second position.

18. The exercise machine according to claim 15, wherein the first handle portion and the second handle portion travel in converging planes as the first handle portion and the second handle portion are moved from the second position to the first position.

19. The exercise machine exercise machine according to claim 15, wherein the first handle portion and the second handle portion are substantially vertically oriented.

20. The exercise machine according to claim 15, wherein the first handle portion and the second handle portion are adapted to be grasped by a user, such that the user's forearms remain substantially parallel to the ground as the first handle portion and the second handle portion are moved.

21. The exercise machine according to claim 15, wherein the input assembly comprises a pair of four-bar linkage mechanisms pivotally connected to the frame, the pair of four-bar linkage mechanisms each including a primary lever arm pivotable about a primary axis, a secondary lever arm pivotable about a secondary axis, and the first handle portion and the second handle portion operatively associated with one each of the primary and secondary lever arms.

22. The row exercise machine according to claim 15, further comprising a user support structure including: a seat mounted to the frame; and a chest pad mounted to the frame above and in front of the seat.

23. A row exercise machine comprising: a frame; user support structure mounted to the frame including a seat and a chest pad; an input assembly pivotably mounted to the frame forward and above of the seat, the input assembly including a pair of four-bar linkage mechanisms each having a primary lever arm pivotable about a primary axis, a secondary lever arm pivotable about a secondary axis, a pair of handle portions operably operatively associated with one each of the primary and secondary lever arms and defining a substantially linear path when moved from a first position to a second position, wherein the pair of handle portions travel to a nadir of the substantially linear path as the pair of handle portions are moved from the first position to the second position and the pair of handle portions travel to an apex of the substantially linear path as the pair of handle portions are moved from the second position to the first position; and a resistance mechanism operably connected to the input assembly.

24. The exercise machine according to claim 22, wherein the pair of handle portions travel in diverging planes as the pair of handle portions are moved from the first position to the second position.

25. The exercise machine according to claim 22, wherein the pair of handle portions travel in converging planes as the pair of handle portions are moved from the second position to the first position.

* * * * *